United States Patent [19]

Matsui et al.

[11] 4,353,053

[45] Oct. 5, 1982

[54] ROTARY VARIABLE RESISTOR

[75] Inventors: Hiroshi Matsui; Matsuo Nishioka, both of Hirakata; Takashi Onizawa, Sakai, all of Japan

[73] Assignee: Matsushita Electric Industrial Co., Ltd., Kadoma, Japan

[21] Appl. No.: 196,566

[22] Filed: Oct. 14, 1980

[30] Foreign Application Priority Data

Oct. 19, 1979 [JP] Japan ..... 54-145527[U]

[51] Int. Cl.[3] ..... H01C 10/32

[52] U.S. Cl. ..... 338/184; 338/132; 338/134; 338/199

[58] Field of Search ..... 338/132, 134, 162–164, 338/174, 184, 199

[56] References Cited

U.S. PATENT DOCUMENTS

| | | | |
|---|---|---|---|
| 3,201,737 | 8/1965 | Mathison | 338/184 X |
| 3,456,227 | 7/1969 | Paine et al. | 338/164 |
| 3,588,778 | 6/1971 | Edwards, Jr. | 338/174 X |
| 3,657,688 | 4/1972 | Casey et al. | 338/174 X |
| 3,676,822 | 7/1972 | Slagg et al. | 338/134 X |
| 3,997,864 | 12/1976 | Oka et al. | 338/162 X |
| 4,114,132 | 9/1978 | DeRouen et al. | 338/174 |

FOREIGN PATENT DOCUMENTS 2250460 5/1975 France .

*Primary Examiner*—C. L. Albritton

*Attorney, Agent, or Firm*—Cushman, Darby & Cushman

[57] ABSTRACT

A rotary variable resistor comprising an insulation substrate having a partial-ring form resistor layer on the surface thereof, an operational shaft rotatably supported at a central portion of the insulation substrate, a brush supporter of a rotational body disposed substantially at one tip of the operational shaft and holding a brush rotatably sliding on the resistor layer, and a cover case of an insulation mold material covering the brush and the brush supporter, the improvement is that the rotational movement of the operational shaft is effectively stopped by a protrusion disposed on the inner wall of a thick part of a plastic mold cover case and on the side of lead terminals.

3 Claims, 5 Drawing Figures

ROTARY VARIABLE RESISTOR

BACKGROUND OF THE INVENTION

1. Field of the Invention

The present invention relates to a rotary variable resistor, more particularly to a structural improvement of the same.

2. Prior Arts

A conventional rotary variable resistor is shown in FIGS. 1 and 2. FIG. 1 is a cross-sectional view showing a double-shaft rotary variable resistor comprising a front block A and a rear block B. FIG. 2 is an exploded partial perspective view showing principal portions of the double-shaft rotary variable resistor seen by separating it at the line C—C in FIG. 1. An external shaft 2 for the front block A and an internal shaft 3 for the rear block B are coaxially journalled by a bearing sheath 1 which is to be fixed to a stereo case or the like by means of a nut.

The front block A is a single-type variable resistor. On the other hand, the rear block B is a tandem-type variable resistor. The rear block B comprises a pair of insulation substrates 12 and 13 with resistor layers 10 and 11 of a ring form with a gap respectively on each one inner surface thereof, a brush holder 16 (revolving body), a fixed center terminal 17', a pair of fixed terminals 17 and 17'', and an insulation case 19 of a molded material.

The brush holder 16 holds rings 161 and 162 with two pairs of brushes 14 and 15 rotatably sliding respectively on the resistor layers 10 and 11, and is disposed at one oval-shaped tip of the inner shaft 3. Three terminals 17, 17' and 17'' are fixed to one end of the insulation substrate 12. The fixed center terminal 17' is electrically connected with the ring 161 by means of a sliding brush 14' fixed at the foot of the center terminal 17' and sliding on the surface of the ring 161. Two fixed terminals 17 and 17'' are electrically connected with respectively each one end of the resistor layer 10 of the ring form with the gap.

Three terminals 18, 18' and 18'' are fixed to one end of the insulation substrate 13, similarly to the case of the terminals 17, 17' and 17''. The fixed center terminal 18' is electrically connected with the ring 162 by means of a sliding brush 15' fixed at the foot of the center terminals 18' and sliding on the surface of the ring 162. Two fixed terminals 18 and 18'' (not shown) are electrically connected with respectively each one end of the resistor layer 11 of the ring form with the gap.

The front block A comprises an insulation substrate 5 with a resistor layer 4 of a partial ring form on one inner surface thereof, a brush holder 7 (revolving body), a fixed center terminal 8', two fixed terminals 8 and 8'' (not shown) disposed respectively on both sides of the fixed center terminal 8', similarly to the case of the fixed terminals 17 and 17'' of the rear block B, and an insulation case 9 of a molded material. The brush holder 7 holds a ring 7' with a pair of brushes 6 rotatably sliding on the resistor layer 4, and is disposed at one tip of the external shaft 2. Three terminals 8, 8' and 8'' are fixed to one end of the insulation substrate 5. The fixed center terminal 8' is electrically connected with the ring 7' by means of a sliding brush 6' fixed at the foot of the center terminal 8' and sliding on the surface of the ring 7'. Two fixed terminals 8 and 8'' are electrically connected with respectively each one end of the resistor layer 4 of the ring form with the gap.

The front and rear blocks A and B are stacked and embraced by a metal fitting 20 supported by the foot of the bearing sheath 1. A protrusion 21 is provided in the front block A as a stopper to stop the rotational movement of the outer shaft 2. The protrusion 21 is disposed on the inner wall of the insulation case 9 opposite to a wall 9' on the lead-out side of the terminals 8, 8' and 8'', so that a protrusion 22 of the brush holder 7 abuts on the protrusion 21 when the outer shaft 2 is turned in full scale. Similarly, a protrusion 23 is provided in the rear block B as a stopper to stop the rotational movement of the inner shaft 3. The protrusion 23 is disposed on the inner wall of the insulation case 19 opposite to a wall 19' on the lead-out side of the terminals 17 and 18, so that a protrusion 24 of the brush holder 16 abuts on the protrusion 23 when the inner shaft 3 is turned in full scale. In both blocks A and B, it is customary to dispose the stopper protrusion 21 (and 23) at a place opposite to the side of a groove 9'' (and 19'') for lead-out terminals 8, 8' and 8'' (and 17, 17' and 17'' and 18, 18' and 18''). In this structure, when the outer shaft 2 (or the inner shaft 3) is fully rotated, the rotational movement of the brush holder 7 (or 16) exerted by the rotation of the outer shaft 2 (or the inner shaft 3) is stopped by abutment of the protrusion 22 (or 24) of the brush holder 7 (or 16) on the protrusion 21 (or 23) in the insulation case 9 (or 19). The resistance force to stop the rotation of the outer shaft 2 (or the inner shaft 3) is determined by structural strength of the stopper protrusion 21 (or 23) disposed inside the insulation case 9 (or 19).

In general, the insulation case 9 (or 19) is made of an insulation material for molding, and is flexible to some extent. And when a strong force is exerted on the stopper protrusion 21 (or 23), not the stopper protrusion 21 (or 23) but a side wall portion 25 (or 26) at the foot thereof is liable to be deformed as shown in FIG. 3. In the worst case, the protrusion 22 (or 24) of the brush supporter 7 (or 16) is no more engaged with the stopper protrusion 21 (or 23) in the insulation case 9 (or 19).

These problems may be solved by a measure that the side wall portion 25 (or 26) at the foot of the stopper protrusion 21 (or 23) is reinforced by making its thickness thicker. But this makes the size of the insulation case 9 (or 19) larger.

In recent years, small-sized audio appliance sets such as car stereo sets have become compact and more functional. Accordingly, it is required that variable resistors used in such audio sets be more compact and more functional than ever. On the other hand, knobs used for the operation of the variable resistors are not always small in size, rather, there is a tendency that their sizes become larger partly in view of set design. In this situation, a large rotational force is liable to be exerted on a stopper, and therefore the stopper should be stronger so as not to make deformation of its shape when it stops the rotational movement of the resistor shaft. The conventional rotary variable resistors have shortcomings in this respect, as described above.

SUMMARY OF THE INVENTION

The invention provides a rotary variable resistor with an improved structure wherein a strong resistance force to stop the rotational movement of the shaft is obtainable while retaining its size as small as possible.

DESCRIPTION OF THE PREFERRED EMBODIMENT

This invention provides a rotary variable resistor comprising:

an insulation substrate having a resistor layer on the surface thereof of a partial ring form, an operational shaft rotatably supported at a central portion of the insulation substrate, a brush supporter of a rotational body disposed at one tip of the operational shaft and holding a brush rotatably sliding on the resistor layer, and a cover case of an insulation material covering the brush and the brush supporter, the improvement is that a protrusion for stopping the rotational movement of the brush supporter is disposed on the inner wall of the case on the side of the part having lead terminals.

A preferred embodiment of the present invention will be described below with reference to FIGS. 4 and 5.

Figure 1:
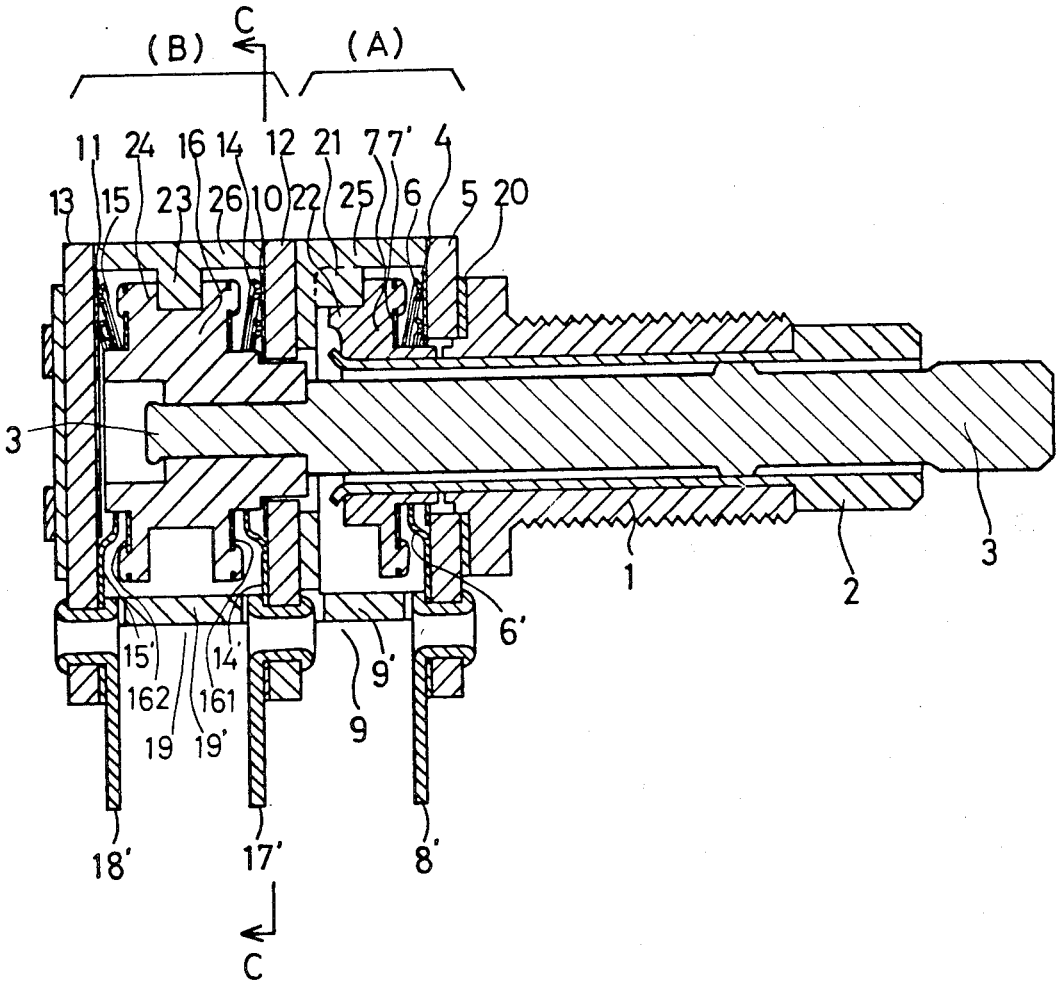
FIG.1 (Prior Art)
FIG. 1 is a cross-sectional view showing a conventional double-shaft rotary variable resistor.
Figure 2:
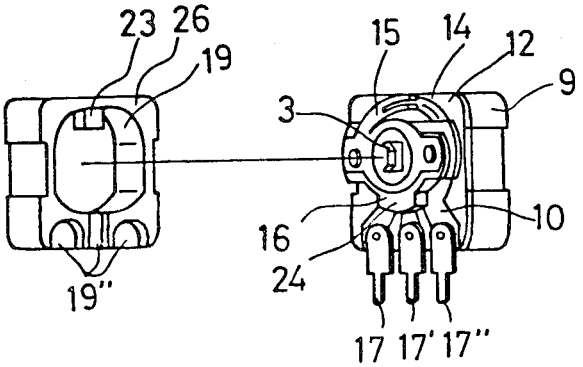
FIG. 2 (Prior Art)
FIG. 2 is an exploded perspective view showing principal parts of the conventional double-shaft rotary variable resistor of FIG. 1.
Figure 3:
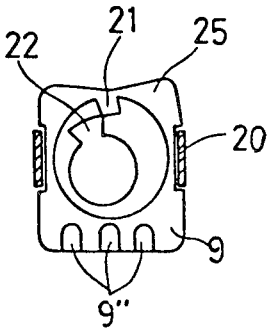
FIG. 3(Prior Art)
FIG. 3 is a top view of an insulation case used in a front side block of FIG. 1.
Figure 4:
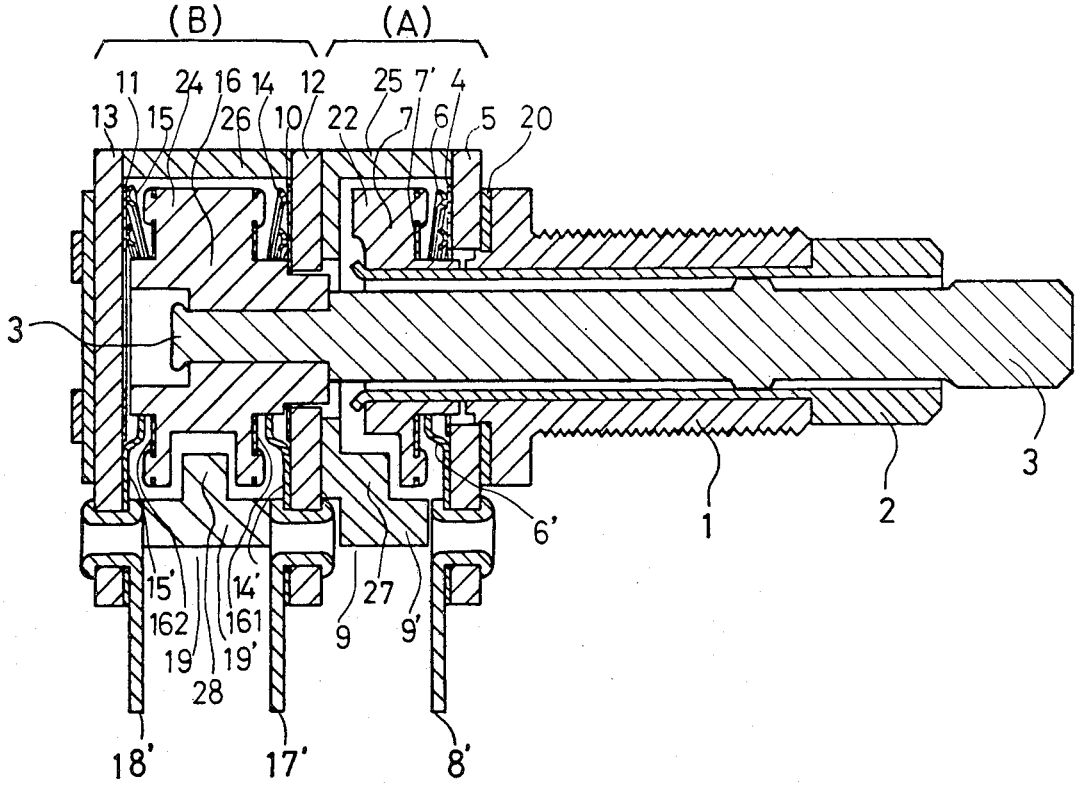
FIG. 4 is a cross-sectional view showing a double-shaft rotary variable resistor in accordance with the present invention.
Figure 5:
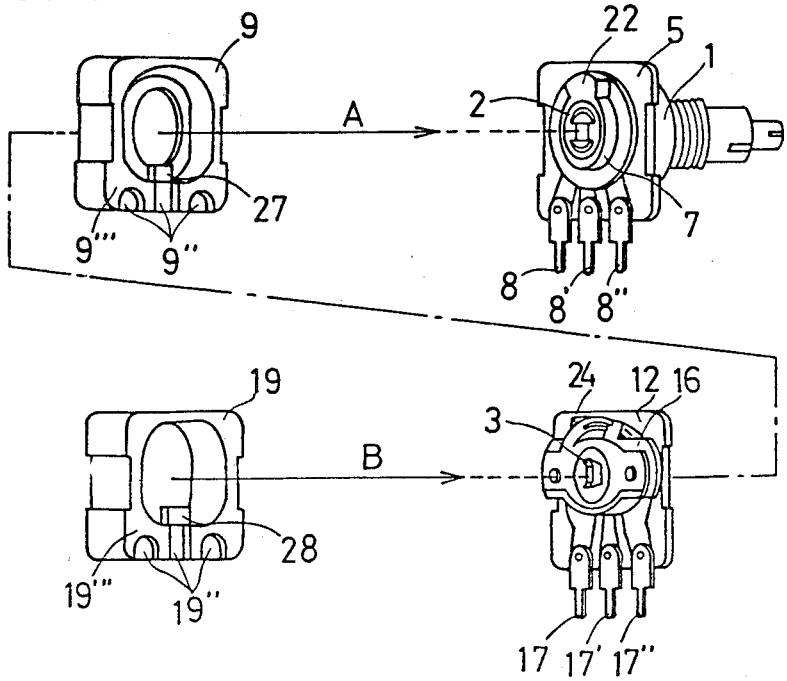
FIG. 5 is an exploded perspective view showing portions of the rotary variable resistor of FIG. 4.

FIG. 4 is a cross-sectional view showing a double-shaft rotary variable resistor in accordance with the present invention. FIG. 5 is an exploded perspective view showing portions in two blocks A and B of FIG. 4. The fundamental structure of the rotary variable resistor in FIG. 4 is similar to the structure shown in FIG. 1. An external shaft 2 for the front block A and an internal shaft 3 for the rear block B are coaxially journalled by a bearing sheath 1 which is to be fixed to a stereo case or the like by means of a nut. The front block A is a single-type variable resistor. On the other hand, the rear block B is a tandem-type variable resistor.

The front block A comprises an insulation substrate 5 with a resistor layer 4 of a partial ring form on one inner surface thereof, a brush holder 7 (revolving body), a fixed center terminal 8', two fixed terminals 8 and 8" disposed respectively on both sides of the fixed center terminal 8', and an insulation case 9 of a molded material. The brush holder 7 holds a ring 7' with a pair of brushes 6 rotatably sliding on the resistor layer 4, and is disposed at one tip of the external shaft 2. Three terminals 8, 8' and 8" are fixed to one end of the insulation substrate 5. The fixed center terminals 8' are electrically connected with the ring 7' by means of a sliding brush 6' fixed at the foot of the center terminal 8' and sliding on the surface of the ring 7'. Two fixed terminals 8 and 8" are electrically connected with respectively each one end of the resistor layer 4 of the ring form with the gap.

The rear block B comprises a pair of insulation substrates 12 and 13 with resistor layers 10 and 11 of a ring form with a gap respectively on each one inner surface therof, a brush holder 16 (revolving body), a fixed center terminal 17', a pair of fixed terminals 17 and 17" disposed respectively on both sides of the fixed center terminal 17', and an insulation case 19 of a molded material.

The brush holder 16 holds rings 161 and 162 with two pairs of brushes 14 and 15 rotatably sliding respectively on the resistor layers 10 and 11, and is disposed at one oval-shaped tip of the inner shaft 3. Three terminals 17, 17' and 17" are fixed to one end of the insulation substrate 12. The fixed center terminal 17' is electrically connected with the ring 161 by means of a sliding brush 14' fixed at the foot of the center terminal 17' and sliding on the surface of the ring 161. Two fixed terminals 17 and 17" are electrically connected with respectively each one end of the resistor layer 10 of the ring form with the gap.

Three terminals 18, 18' and 18" are fixed to one end of the insulation substrate 13, similarly to the case of the terminals 17, 17' and 17". The fixed center terminal 18' is electrically connected with the ring 162 by means of a sliding brush 15' fixed at the foot of the center terminals 18' and sliding on the surface of the ring 162. Two fixed terminals 18 and 18" (not shown) are electrically connected with respectively each one end of the resistor layer 11 of the ring form with the gap.

The front and rear blocks A and B are stacked and embraced by a metal fitting 20 supported by the foot of the bearing sheath 1. The difference from the conventional structure is a stopper structure used for stopping the rotational movement of a brush holder 7 (and 16). A stopper protrusion 27 (and 28) is disposed on the inner wall 9''' (and 19''') of a case 9 (and 19) on the side of lead terminals 8, 8' and 8" (and 17, 17' and 17" and 18, 18' and 18"). The thickness of the inner wall 9''' (and 19''') is much thicker than that of other portions for the purpose of reinforcing, that is, increasing rigidity of the portion at the foot of the stopper protrusion 27 (and 28). The case 9 (and 19) is provided with three grooves 9" (and 19") to be engaged with the lead terminals 8, 8' and 8"(and 17, 17' and 17"). By employing such a structure, the part of the wall having the stopper protrusion 27 (and 28) is very rigid at the foot thereof. When a strong force is exerted on the stopper protrusion 27 (or 28), the protrusion 27 can resist it owing to the rigid structure of being formed on the thick part of the inner wall 9''' (or 19'''). Even when an excessively strong force is exerted on the stopper protrusion 27 (or 28) and resultantly makes a stress to deform the inner wall 19''' (or 19'''), by the abutment of the grooves 9" (or 19") at the lead terminals 8, 8'and 8" (or 17, 17' and 17", or 18, 18' and 18"), the wall part and the protrusion 27 (or 28) are not deformed. Thus, a resistance force of the wall part against the stress is increased to more than twice as compared with the conventional structure.

By increasing rigidity of the inner wall 9''' (and 19'''), where the protrusion 27 (and 28) is provided, the whole size of the rotary variable resistor can be maintained substantially the same. This is because the size of the insulation substrate 5 (12 and 13) is much larger on the side of the lead terminals 8, 8' and 8" (and 17, 17' and 17", and 18, 18' and 18") than other portions, and because the whole size is little affected by making the inner wall 9''' (and 19''') thicker.

Thus ,the improvement in the rotary variable resistor of the present invention can increase durability against an excessive force without increasing the size or the number of composite parts or the production steps.

What is claimed is:

1. In a rotary variable resistor comprising:

at least one insulation substrate having a partial-ring form registor layer on the surface thereof, an operational shaft rotatably supported at a central portion of said insulation substrate, a brush supporter in the form of a rotational body disposed substantially at one tip of said operational shaft and holding a brush rotatably sliding on said resistor layer, and a cover case of molded insulation material covering said brush and said brush supporter, the improvement wherein:

a side of each such insulation substrate has lead terminals;

said cover case is constituted by a peripheral side wall with two ends, defining an internal space which is open at both ends without any intervening partition wall, said peripheral side wall having an internal surface; and a protrusion for stopping the rotationalal movement of said brush supporter is disposed on said inner surface of said peripheral side wall of said cover case on the side of said at least one insulation substrate having said lead terminals.

2. A rotary variable resistor in accordance with claim 1, wherein the wall of said cover case is thicker around the foot of said protrusion than at other portions thereof.

3. A rotary variable resistor in accordance with claim 1, wherein grooves for covering said lead terminals and to be engaged with end portions of said lead terminals are formed at said cover case.

* * * * *